United States Patent [19]

Naidoo

[11] Patent Number: 4,980,981

[45] Date of Patent: Jan. 1, 1991

[54] AUTOMATIC IRONING MACHINE

[75] Inventor: Tholsee Naidoo, City Beach, Australia

[73] Assignee: Aim Industries Australia Limited, Perth, Australia

[21] Appl. No.: 46,880

[22] PCT Filed: Jun. 13, 1986

[86] PCT No.: PCT/AU86/00171

§ 371 Date: Feb. 27, 1987

§ 102(e) Date: Feb. 27, 1987

[87] PCT Pub. No.: WO87/00218

PCT Pub. Date: Jan. 15, 1987

[51] Int. Cl.[5] ..... D06F 61/02

[52] U.S. Cl. ..... 38/1 C; 38/7; 38/46; 38/82; 38/144; 223/57; 223/70

[58] Field of Search ..... 38/44, 46, 56, 57, 60, 38/66, 1 C, 7, 144, 82, 20, 49, 55; 223/57, 70

[56] References Cited

U.S. PATENT DOCUMENTS

| | | | |
|---|---|---|---|
| 634,584 | 10/1899 | O'Connor | 38/52 |
| 1,054,721 | 3/1913 | Simon | 38/52 |
| 1,641,315 | 9/1927 | Brown | 38/52 |
| 1,649,337 | 11/1927 | Brewer | 38/49 |
| 1,679,808 | 8/1928 | Brown | 38/52 |
| 2,911,729 | 11/1959 | Wood | 34/37 |
| 3,185,816 | 5/1965 | Lusebrink | 38/44 X |
| 4,197,663 | 4/1980 | Riedel | 38/49 X |
| 4,219,948 | 9/1980 | Miranker | 38/10 |
| 4,485,573 | 12/1984 | Kamberg | 38/44 |

FOREIGN PATENT DOCUMENTS

| | | | |
|---|---|---|---|
| 2206069 | 8/1972 | Fed. Rep. of Germany . | |
| 3002057 | 12/1979 | Fed. Rep. of Germany . | |
| 56389 | 7/1953 | France . | |
| 2124767 | 9/1972 | France . | |
| 2113752 | 11/1972 | France . | |
| 2595380 | 9/1987 | France | 38/44 |
| WO84/02364 | 6/1984 | PCT Int'l Appl. . | |
| 1212159 | 11/1970 | United Kingdom . | |
| 1380731 | 9/1971 | United Kingdom . | |

*Primary Examiner*—Peter Nerbun

*Attorney, Agent, or Firm*—Harness, Dickey & Pierce

[57] ABSTRACT

An ironing machine for automatically ironing garments or other articles which are conveyed through the machine on hangers. The machine comprises an ironing zone to receive an article to be ironed and a heat applying means for applying heat to an article received at the ironing zone. The heat applying means is mounted on a shuttle which is movable relative to the ironing zone for traversing that zone. The heat applying means includes two opposed heat applying surfaces one disposed on each side of the ironing zone for contacting a surface of an article at the ironing zone and conforming to the surface contour thereof while traversing the ironing zone.

41 Claims, 11 Drawing Sheets

AUTOMATIC IRONING MACHINE

This invention relates to an ironing machine for ironing articles such as garments and textile piece goods including sheets, towels, handkerchiefs, tablecloths, place mats, curtains and the like.

The term "ironing" as used herein shall be taken to mean a treatment performed on an article for the purpose of removing wrinkles from the article, particularly after laundering, wearing or otherwise using the article. The ironing process may involve the application of heat, pressure, steam or a combination of one or more of such treatments to the article.

Ironing is a labour intensive task which some people find rather tedious. At present, ironing is generally performed either with a hand-held, heated iron, or with a manually operated ironing machine having a pair of pressing surfaces which are moved together so as to press an article therebetween with heat being applied to at least one of the pressing surfaces. In both cases, an operator is required to perform the ironing task.

There is a need for an ironing machine which operates automatically. In the Australian patent application Ser. No. 23391/83 there is disclosed an apparatus for automatically ironing articles. The apparatus has a pair of co-operating pressing rollers which are adapted to be disposed one on each side of a article to be ironed. The rollers are movable between a spaced position in which the rollers are clear of the article and a pressing position in which the rollers are in pressing contact with the article. The rollers are further movable in unison over the article while in the pressing position and means are provided for applying steam to the article as the rollers traverse the article. While this apparatus has performed satisfactorily on articles which are of uniform thickness, it has not proved altogether satisfactory on articles which have surface irregularities or are of varying thickness owing to, for example, the presence of padded sections, pockets, buttons and zips. For the most part, the difficiency arises because the rollers move apart as they encounter areas of increasing thickness and, in doing so, may leave adjacent areas inadequately pressed.

It is an object of this invention to provide an ironing machine which is capable of accommodating irregularities in the surfaces of articles to be ironed.

In one form the invention resides in an ironing machine comprising an ironing zone to receive an article to be ironed, a heat applying means for applying heat to an article received at the ironing zone, the heat applying means being movable relative to the ironing zone for traversing the ironing zone, the heat applying means including two opposed heat applying surfaces one disposed on each side of the ironing zone for contacting a surface of an article at the ironing zone and conforming to the surface contour thereof while traversing the ironing zone.

In one arrangement the heat applying surfaces may each be defined by a plurality of movable elements.

The movable elements may be in the form of fingers of heat conductive material, said fingers being urged into a contacting position for contacting an article at the ironing zone. The fingers effectively float on the surface of the article so as to accommodate any irregularities in the surface thereof.

In addition to applying heat to an article at the ironing zone, the fingers or other movable elements may apply pressure thereto so as to enhance the ironing process.

The fingers may mounted for angular movement about an axis transverse to the direction of traverse of the ironing zone. In the preferred arrangement, the fingers are of resilient sheet material (such as stainless steel) and fixed at one end only so as to extend therefrom in cantilever fashion. Each finger is shaped to slidingly contact the article at the ironing zone. The resilient nature of the sheet material permits angular movement of the finger to accommodate irregularities in the surface of the article.

The fingers or other movable elements may be in heat conductive relationship with a heat source, or may be remote from the heat source and heat reflected or otherwise transmitted to the fingers or other movable elements.

In another arrangement, the heat applying surfaces may each be in the form of a resiliently deformable surface. The resiliently deformable surface may be defined by a pad of resiliently deformable construction. The heat applying surfaces are preferably of low-friction material. The pad may be provided with an electrical resistance heating element.

To achieve good ironing results, it may be desired to apply steam to the article prior to the application of heat thereto. The steam not only applies useful heat to the article but also water which may have the effect of conditioning the article for the ironing process. To this end, the ironing machine may further comprise steam applying means for applying steam to the article ahead of or in conjunction with the application of heat to the article by the heat applying means.

For some articles, it may be desirable to apply pressure thereto following the application of heat to the article. To provide for this, the ironing machine may comprise a pressing means disposed rearwardly of the heat applying means. The pressing means may comprise a pair of co-operating pressing surfaces provided on opposed sides of the ironing zone. The pressing surfaces may be in the form of pressing rollers which may be freely rotating or driven.

The ironing machine may also be provided with a spreading means for spreading an article at the ironing zone for the purpose of removing folds prior to the ironing operation. The spreading means may comprise rotatable devices which engage the article and impart sideways thrust thereto to effect the spreading action.

The heating, steaming, pressing and treatments are preferably controlled independently of each other so that any one or more of such treatments may be employed in a particular ironing operation.

For preference, the heat applying means, steam applying means, pressing means and spreading means are carried on a shuttle which is arranged to traverse the ironing zone.

Preferably, articles are conveyed through the ironing machine supported on hangers.

Preferably, a transfer means is provided for transferring each article from a first storage zone to the ironing zone at which the ironing operation is performed and thereafter transferring the ironed article to a second storage zone.

To achieve good results, it is desirable for the ironing process performed by the ironing machine to be varied according to the type of article to be ironed. For example, a shirt of polyester and cotton requires an ironing process which is different to that required by a woollen dress. The variations may include the temperature at which heat is applied to the article, the quantity of steam applied to the article, the pressure at which the article is pressed and the rate at which such, treatments are performed on the article. To account for this, the ironing meachine may have an article identification means for identifying the type of article delivered to the ironing zone. The ironing machine may also have a fabric identification means for identifying the type of fabric from which the article is made. In one arrangement, the identification of the article may be carried out with the aid of identifying marks or codes on the hangers on which the articles are supported. In another arrangement, the machine may be provided with a first means for identifying the type of article at the ironing zone and generating a first signal representative thereof, a second means for detecting the type of fabric from which the article is made and generating a second signal representative thereof, and a control means arranged to receive the first and second signals and being operable to control one or more variables of the ironing process according to the type of article and the fabric type. The first means for identifying the article may comprise an imaging system for scanning the article and registering the image thereof. Preferably, the imaging means is not only capable of scanning the article to determine its type prior to the ironing process, but it is also capable of scanning the article after the ironing process to evaluate whether or not the article has been ironed satisfactorily. If the ironing process is satisfactory, the article is transferred away from the ironing zone. On the other hand, if the ironing process is not satisfactory, it is repeated.

The invention will be better understood by reference to the following description of two specific embodiments thereof as shown in the accompanying drawings in which.

The embodiments are directed to an ironing machine primarily for domestic use.

Figure 1:
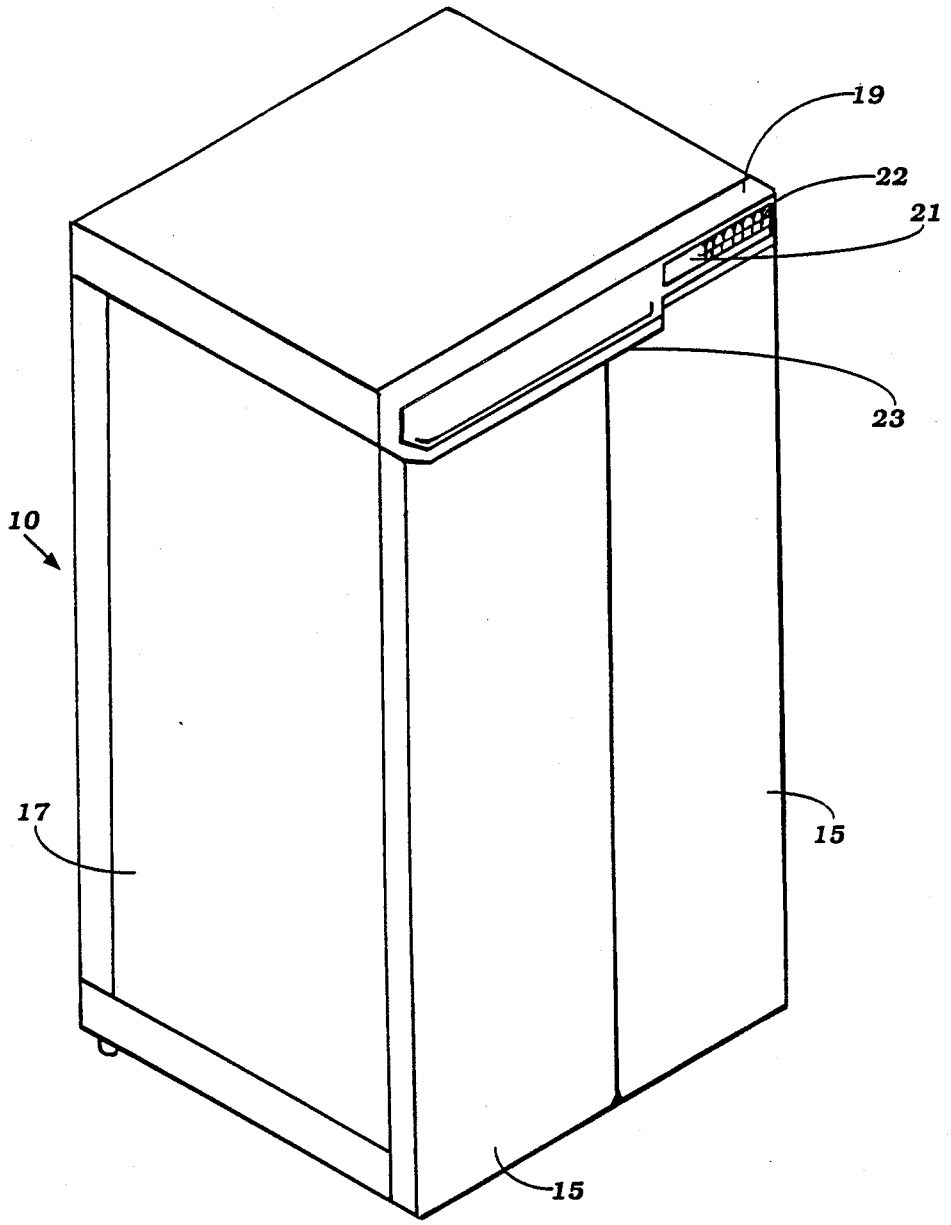
FIG. 1 is a perspective view of the exterior of an ironing machine according to the first embodiment, with the ironing machine shown in an inoperative condition.
Figure 2:
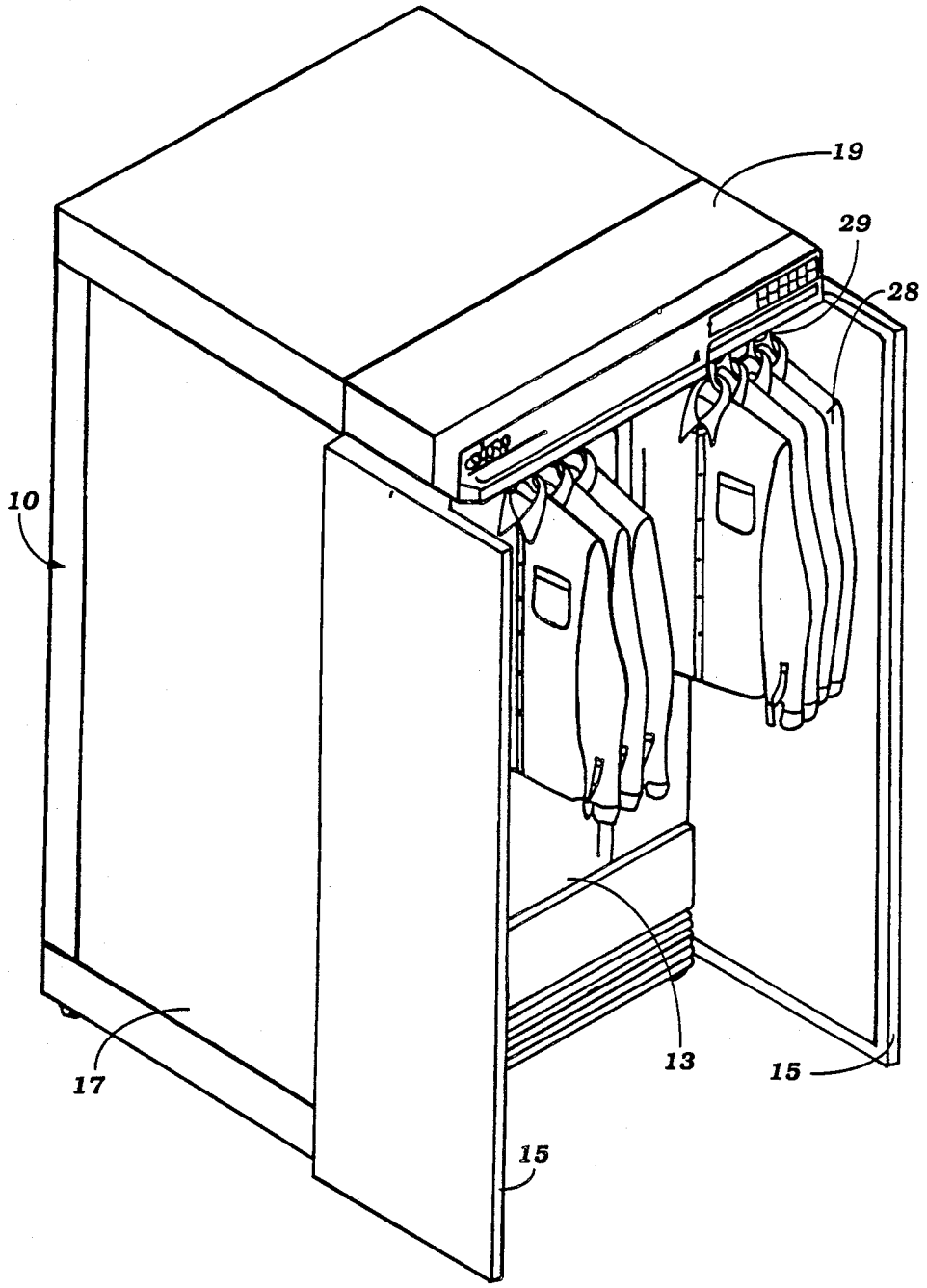
FIG. 2 is a perspective view of the exterior of the ironing machine, with the machine being shown in an operative condition.
Figure 3:
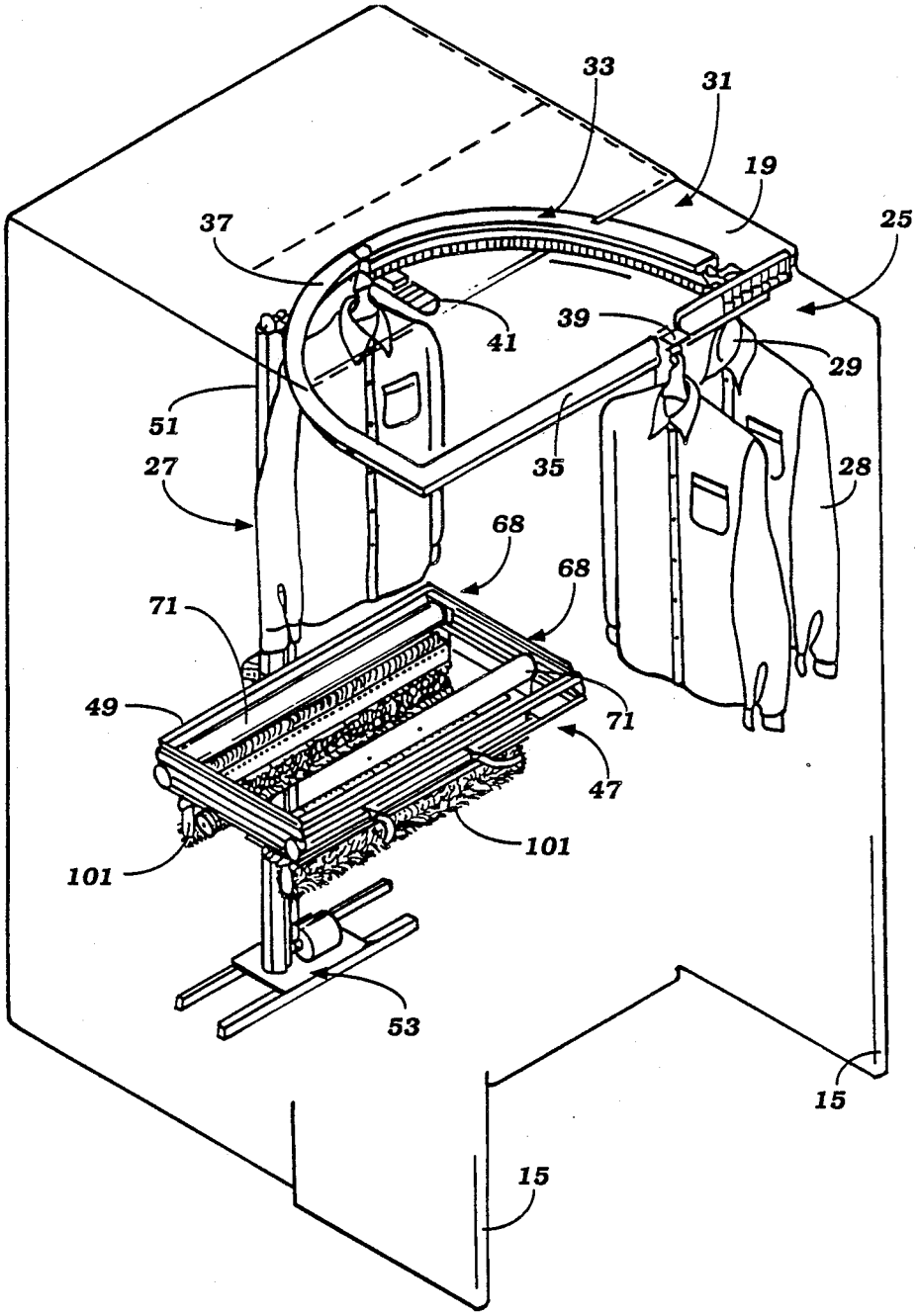
FIG. 3 is a schematic perspective view of the interior of the ironing machine.

Referring to FIGS. 1 to 8, the ironing machine according to the first embodiment comprises a housing 10 having an internal frame structure 11 and an interior 13 access to which is gained by means of a pair of swing doors 15. Each swing door 15 is mounted on the adjacent side wall 17 of the housing for pivotal movement about a substantially vertical axis. A movable carriage 19 is mounted on the housing 11 at the upper end thereof. The carriage 19 supports a console 21 at its front end. The console 21 is provided with a control panel 22. The carriage 19 is movable in a generally horizontal plane between a retracted position (as shown in FIG. 1) in which it lies substantially within the interior of the housing 11 with the console 21 closely adjacent the front of the housing, and an extended position (as shown in FIG. 2) in which the carriage extends beyond the housing 10. In the extended position, the carriage provides a canopy for the front of the housing. The carriage is provided with a handle 23 whereby the carriage may be grasped to facilitate movement between the extended and retracted positions.

The ironing machine includes a storage zone 25 and a ironing zone 27. At the storage zone 25, articles 28 which are to be ironed, are supported on hangers 29. In the drawings, the articles are depicted as garments, more particularly shirts. Articles at the storage zone are transferred in turn from one end thereof to the zone 27 at which an ironing operation is performed. After each article has been ironed, it is returned to the storage zone 25 via the other end thereof. In this way, articles awaiting ironing at the storage zone are ironed in succession.

A transfer means 31 is provided for transferring each article at the storage zone in turn from the storage zone to the ironing zone and then returning it to the storage zone. The transfer means includes a track 33 provided on the underside of the movable carriage 19. The track 33 includes a straight section 35 which is located above the storage zone and a curved section 37 which extends from one end of the straight section 35 to the other end thereof. Each garment hanger 29 is connected to the track 33 by means of a carrier member 39. The carrier member 39 has a head which engages a track and a shank which is adapted to be engaged by the hanger. A feed means 41 is provided for feeding the carrier members 39 in turn along the track in timed sequence with other parts of the machine.

The ironing zone 27 is contained within the housing 10 and the curved section 37 of the track 33 passes over that zone.

A shuttle 47 is arranged to traverse the vertical extent of the ironing zone 27 between uppermost and lowermost positions. The shuttle includes a rectangular frame 49 which surrounds the ironing zone. The rectangular frame is mounted on a support post 51 for movement therealong. The post 51 is of hollow construction and is mounted within the housing. A drive system 53 is provided for moving the shuttle 47 between the upper and lower positions. The drive system 53 comprises an endless cable 54 or other element passing around an upper pulley 55 and a lower pulley (not shown). The lower pulley is drivingly connected to a drive motor 57 located adjacent the base of the support post. One run of the endless cable is located exteriorly of the support post and is attached to the shuttle. The other run of the endless cable passes within the hollow support post and carries a counterweight movable along the interior of the support post for counterbalancing the shuttle. The drive motor 57 is selectively reversable whereby the shuttle may be raised or lowered according to the direction of rotation of the motor. The extent of upward and downward movement of the shuttle is controlled respectively by upper and lower opto-electric limit switches (not shown).

The shuttle carries a pressing means 61, a heat applying means 63, a steam applying means 65 and a spreading means 67 which together provide two opposed ironing assemblies 68, one ironing assembly on each side of the ironing zone 27. The pressing means 61 is uppermost and is supported on the shuttle separately from the heat applying means 63, the steam applying means 65 and the spreading means 67. As will be fully explained hereinafter, the arrangement is such that an article at the ironing zone is first subjected to a spreading action and thereafter steaming, heating and pressing treatments in sequence (provided all such treatments are selected for the article).

The pressing means 61 comprises a pair of co-operating pressing rollers 71 one on each side of the ironing zone. The pressing rollers "re arranged in side-by-side relation with their rotational axes substantially horizontal and parallel. The rolling surface of each roller is resiliently deformable.

Figure 7:
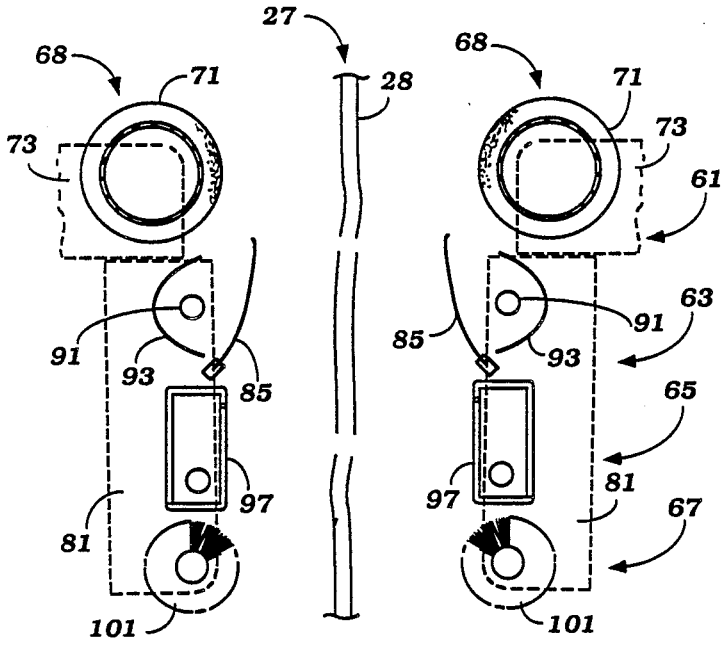
FIG. 7 is a schematic view showing the ironing assemblies in a spaced position with an article to be ironed positioned at the ironing zone.
Figure 8:
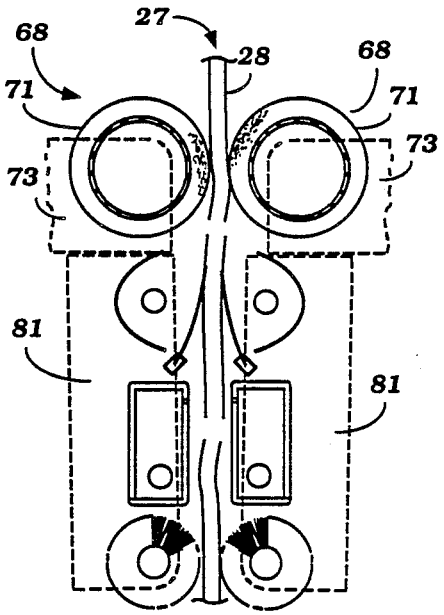
FIG. 8 is a view similar to FIG. 7 except that the ironing assemblies are shown in an ironing position.
Figure 9:
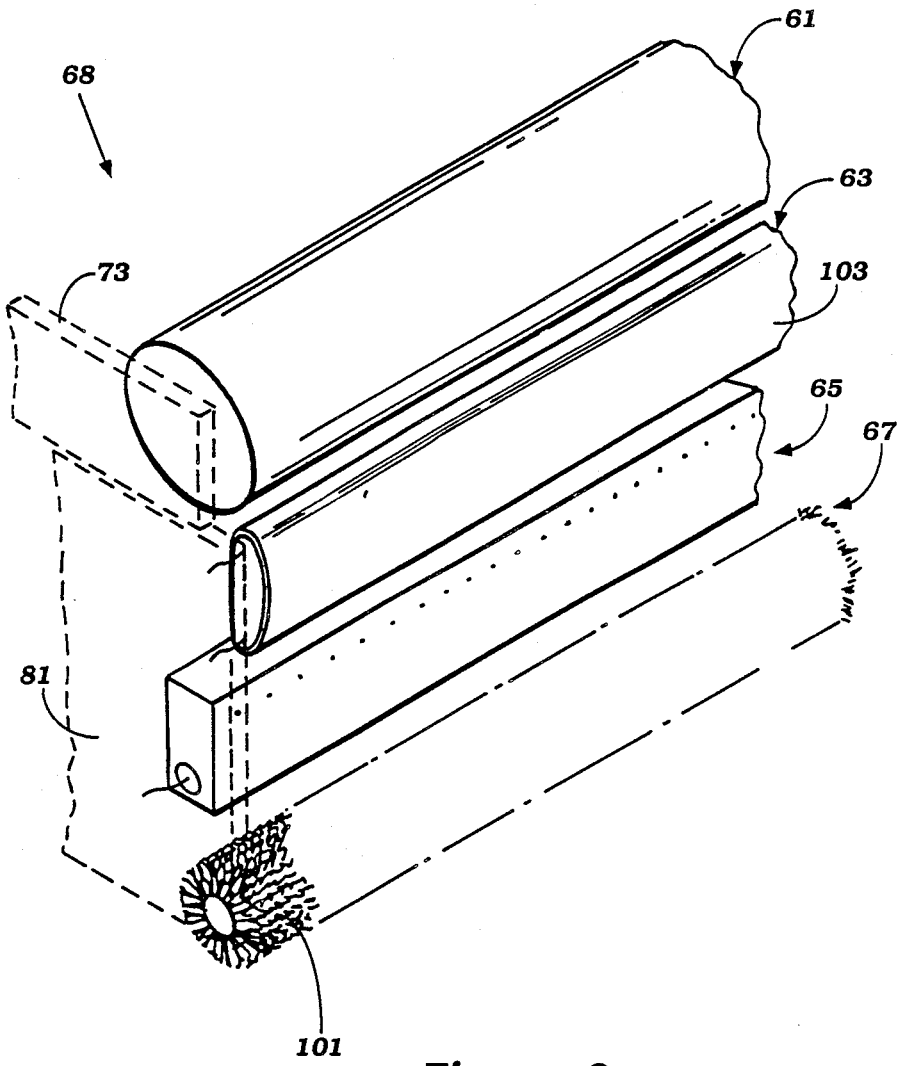
FIG. 9 is a fragmentary perspective view showing an ironing assembly of an ironing machine according to the second embodiment of the invention.
Figure 10:
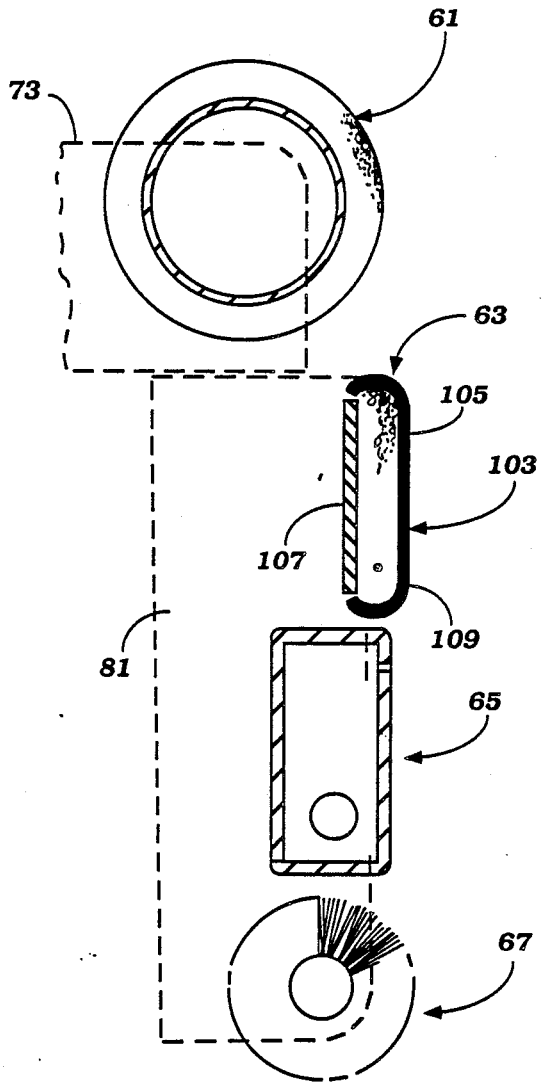
FIG. 10 is an end view of an enlarged scale of the ironing assembly shown in FIG. 9.
Figure 11:
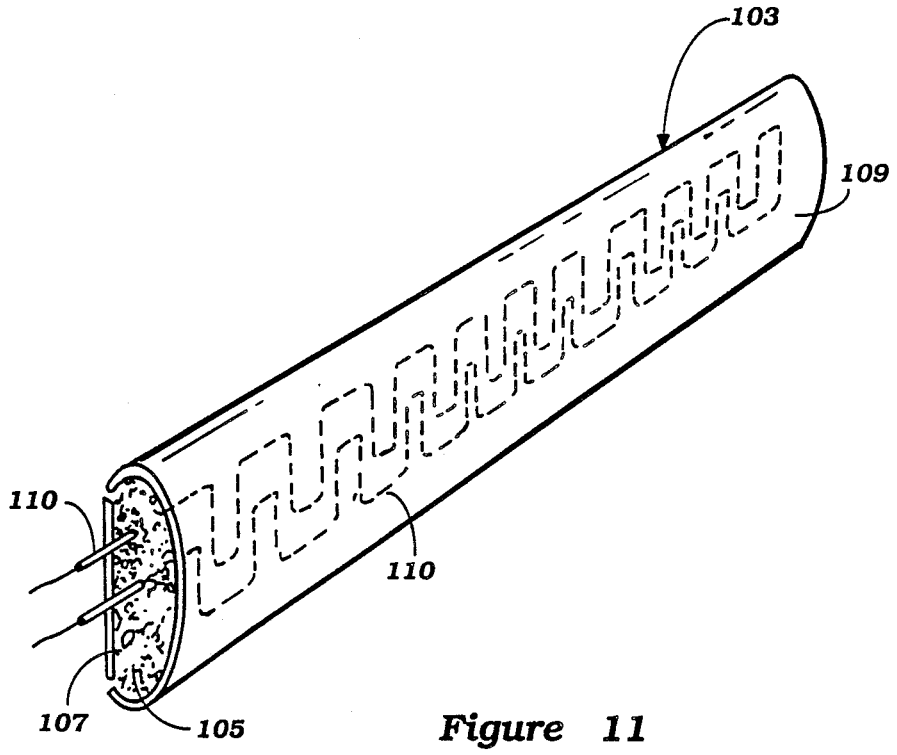
FIG. 11 is a schematic perspective view of a pad which forms part of the ironing assembly of FIG. 9.
Figure 12:
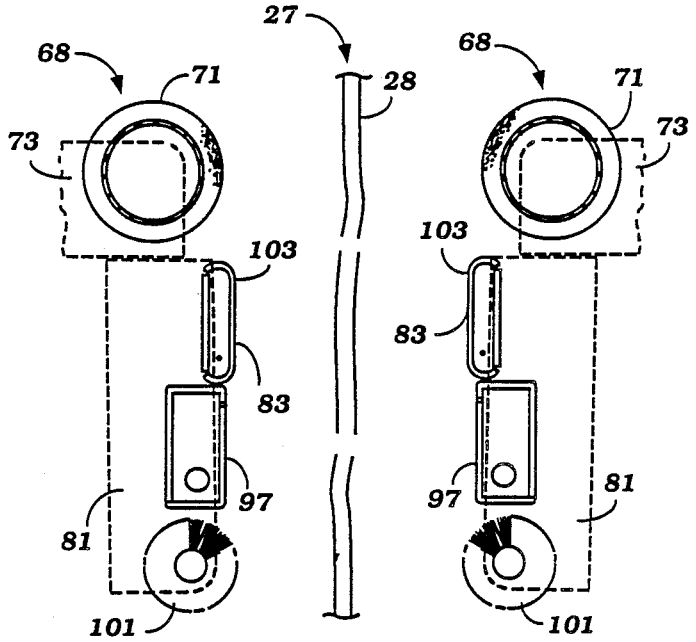
FIG. 12 is a schematic view showing the ironing assemblies of an ironing machine according to the second embodiment in a spaced position with an article to be ironed positioned at the ironing zone.
Figure 13:
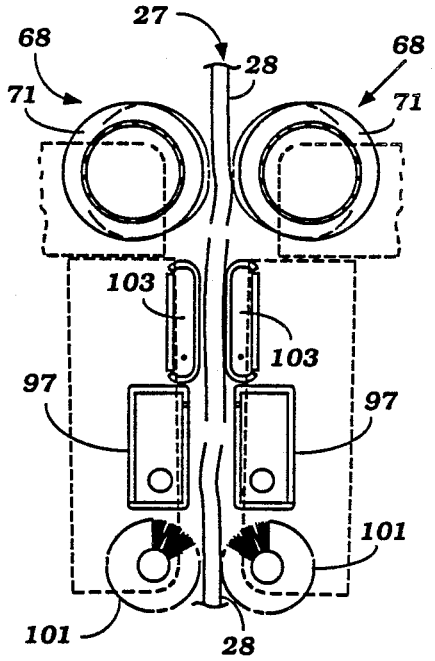
FIG. 13 is a view similar to FIG. 12 except that the ironing assemblies are shown in the ironing position.

The shuttle 47 includes a pair of upper carriages 73 each of which supports one of the rollers 71. The carriages 73 are movable relative to each other to effect movement of the pressing rollers towards and away from each other on the shuttle, between a spaced position (as shown in FIG. 7) in which the rollers are clear of the ironing zone and a pressing position (as shown in FIG. 8) in which the rollers are at the ironing zone for pressing contact with an article positioned at the ironing zone. Movement of the upper carriages relative to each other is controlled by stepping motors 75.

A drive system 77 is provided for rotating the rollers. The drive system 77 includes two passive cables 79 anchored at their ends adjacent the top and bottom of the housing 10. The rollers are operatively coupled to the passive cables so that upward and downward movement of the rollers with the shuttle effects rotation of the rollers. With the illustrated arrangement, each roller completes one revolution on movement of the shuttle between the uppermost and lowermost positions. The passive cables have sufficient lateral play to accommodate movement of the rollers between the spaced and pressing positions.

The shuttle 47 is also provided with a pair of lower carriages 81 disposed on opposed sides of the ironing zone. The lower carriages are movable towards and away from each other under the action of the stepping motors 75. The stepping motors thus control movement of both the upper carriages and the lower carriages. The control arrangement is such that the lower carriages can be moved towards and away from each other independently of the upper carriages.

The heat applying means 63, steam applying means 65 and spreading means 67 are mounted on the lower carriages, with the heat applying means uppermost and the spreading means lowermost.

The heat applying means 63 comprises a pair of opposed heat applying surfaces 83 one mounted on each lower carriage. Each heat applying surface confronts the ironing zone 27 and has a horizontal extent transverse to the direction of movement of the shuttle. In this embodiment, each heat applying surface 83 is defined by a plurality of movable elements in the form of fingers 85 arranged in a row. The two rows of fingers are mounted one on each lower carriage with each finger fixed at one end and extending from such fixed end in cantilever fashion.

Each row of fingers 85 is formed from a sheet of heat conductive, resilient material (such as stainless steel) having a plurality of spaced cuts thereby to form the row of fingers. The sheet material is received at one edge thereof in a strip of non-conductive material 87 fixed to the respective lower carriage 81. The rows of fingers 85 are shaped so as to present a substantially convex heat applying surface 83 to the ironing zone 27. The resiliently flexible nature of the fingers 85 accommodates irregularites in the surface contour of an article at the ironing zone.

Each row of fingers 85 is heated by a heat source 91 which is remote from the fingers and from which heat is reflected by a reflector 93 onto the row of fingers. More particularly, the heat is reflected onto the face 95 of the row of fingers opposed to the ironing zone. The heat source 91 is in the form of a conventional electrical resistance heating element. In an alternative arrangement, the fingers may be in direct contact with the heat source.

The steam applying means 65 comprises a steam generator having two elongated steam generating chambers 97 one mounted on each lower carriage 81 below the respective row of heat applying fingers 85. Each steam generating chamber 97 is adapted to contain water and has a plurality of nozzles 99 spaced along the extent of the chamber on the face thereof confronting the ironing zone 27. A heating element (not shown) is positioned within each chamber 97 for heating water therein to produce steam which in use issues through the nozzles 99. Each steam generating chamber 97 receives water from a secondary reservoir (not shown) which in turn receives water from a main reservoir (also not shown). On each occasion that the shuttle 47 arrives at its lowermost position, a measured quantity of water is transferred to each secondary reservoir from the main reservoir.

The spreading means 67 comprises two brush means 101 on opposed sides of the ironing zone, one brush means being mounted on each lower carriage 81 below the respective steam generating chamber 97. The brush means 101 are arranged so as to contact an article at the ironing zone and thereby impart opposing sideways thrusts to the article to effect spreading whereof for the purpose of removing loose folds from the article. This has the effect of preparing the article for a subsequent ironing treatment. The brush means 101 may be each in the form of a pair rotatable brushes either freely rotatable or power driven. In the case where each brush is freely rotatable, the rotational axis of the brush is offset in relation to the direction of travel of the shuttle whereby forces exerted on the rotatable brush when the latter is in contact with the article at the ironing zone causes rotation of the brush.

With movement of the lower carriages 81 towards and away from each other, the heat applying surfaces 83 of the heat applying means 63 and the brush means 101 of the spreading means 67 each move between a spaced position in which they are clear of the ironing zone 27 and an ironing position in which they are in contact with an article positioned at the ironing zone. The steam generating chambers 97 also move towards and away from each other but at no stage contact the article.

From the foregoing, it is evident that the opposed ironing assemblies 68 each comprise one of the pressing rollers 71, one of the rows of heat applying fingers 85, and one of the sets of steam nozzles 99.

The steam applying means 63, heat applying means 65 and pressing means 61 are controlled independently of each other. In this way, any one or more of the steaming, heating and pressing treatments can employed for a particular ironing operation.

The ironing process to be performed on an article varies according to the nature of the article and the fabric from which it is formed.

Figure 4:
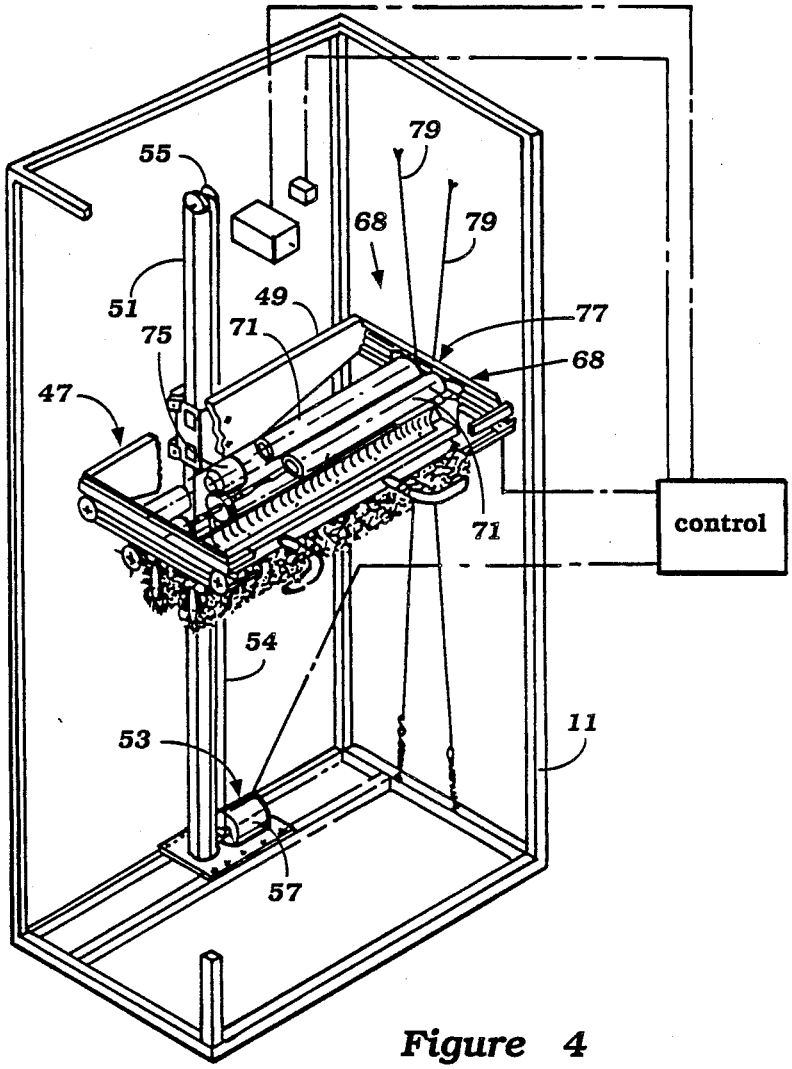
FIG. 4 is a perspective view of the interior of the ironing machine, showing the drive mechanism for the shuttle and omitting other parts.
Figure 5:
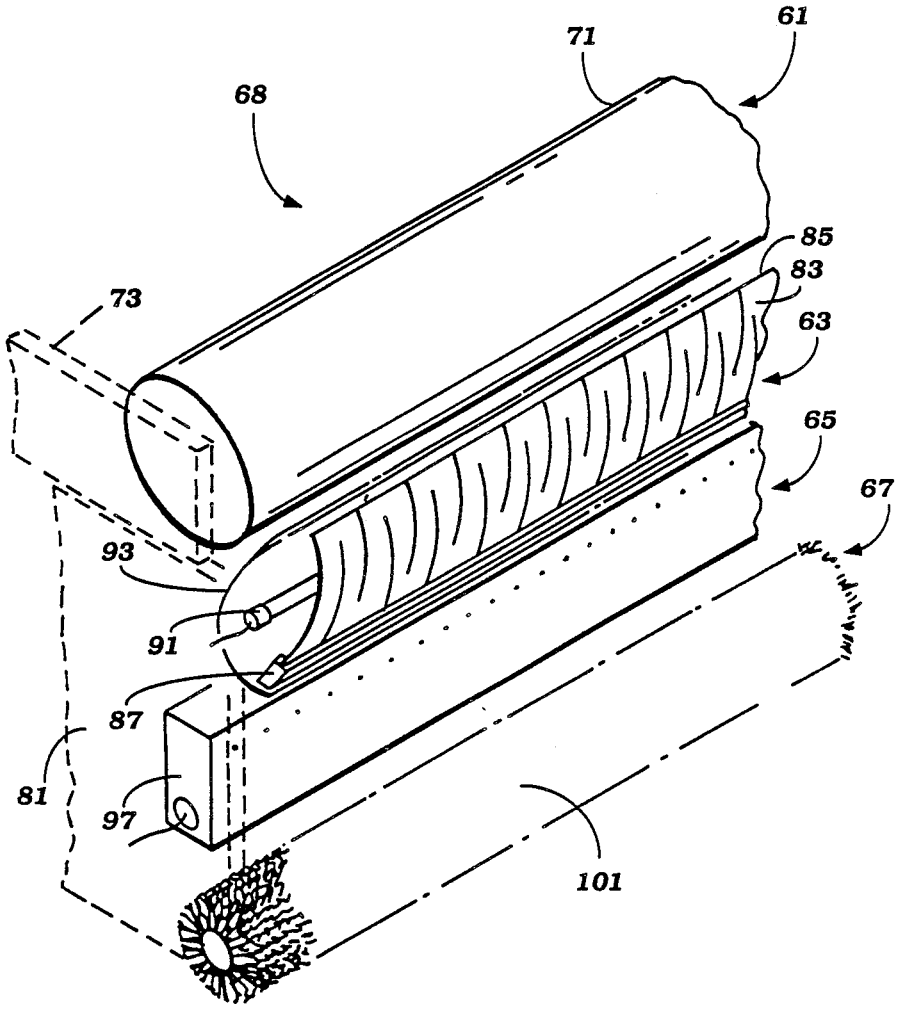
FIG. 5 is a fragmentary perspective view on an enlarged scale showing one of the ironing assemblies.
Figure 6:
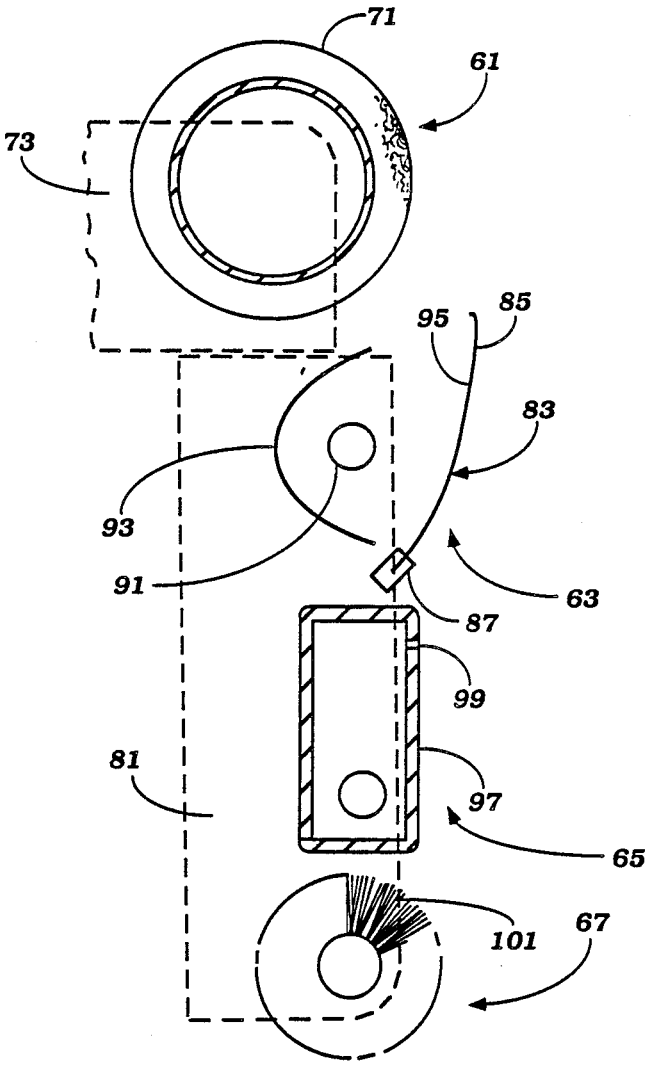
FIG. 6 is an end view on a further enlarged scale of the arrangement of parts shown in FIG. 5.

To account for this, ironing machine may be provided with an article identification means for identifying the type of article and a fabric identifying means for identifying the fabric from which the article is made, such article identification means and fabric identifying means being indicated respectively by the reference numerals 101 and 102 schematically in FIG. 4. The article identifying means may comprise an imaging means having a scanning device for scanning the particular article at the ironing zone to register the image thereof and generating a first signal representative thereof. The fabric identification means may include a sensor for sensing the type of fabric from which the article is made and generating a second signal representative thereof. The first and second signals are applied to a control means in the form of a microprocessor, indicated schematically at 103 in FIG. 4, which is operable to control several variables of the ironing process according to the type of article and its fabric. These variables may include the temperature (if any) to which the heat applying means is heated, the amount (if any) of steam to be applied to the article, the pressure (if any) which is to be applied to the article by the pressing rollers, and the rate at which the various treatments are applied to the article (that is, the shuttle speed).

The imaging means may include in the memory of the microprocessor an image of all forms of articles which may be ironed by the ironing machine. The image of the particular article at the ironing zone is compared with various images in the memory thereby to determine the type of article at the ironing zone. The imaging means not only scans an article to determine its type prior to the ironing process, but may also scan the article after it has been ironed to confirm that it has been ironed satisfactory. In this connection, the image of the article in the microprocessor is that of a properly ironed article. The image of the article which has been ironed is compared to the image of the corresponding properly ironed article and provided that the two images fall within certain limits, the ironing operation is considered to be satisfactory the article is then transferred from the ironing zone to the storage zone. If, on the other hand, the image of the ironed article falls outside the specified limited, the ironing process is repeated.

A means for identifying the type of fabric may comprise an infra-red sensor. In an alternative arrangement, said means may apply energy in the form of heat or electricity to the fabric and sense rate of dissipation thereof which varies according to the nature of the fabric. In a further alternative arrangement, water may be applied to the fabric and the rate of dissipation thereof sensed.

In an alternative arrangement, the hangers 29 on which the articles are supported may each be provided with an identifying mark or code (not shown) which can be detected by the machine to provide an indication of the type of article. This facilitate automatic selection of appropriate variables for the ironing process according to the type of article.

Operation of the ironing machine will now be described. For the purposes of this description, it will, assumed that the ironing process is to include spreading, steaming, heating and pressing treatments.

A user opens the swing doors 15 and slides the movable carriage 19 from the retracted position to the extended position at which it provides a canopy for the area between the opened doors. The user then places garments to be ironed onto hangers and then places the hangers onto the carrier members 39 at the straight section 35 of the track 33. The hangers support the garment in a manner such that two opposed sides are exposed for ironing. This facilitates pressing cf creases into the garments at appropriate locations, such as at the sleeves of shirts and legs of trousers. The ironing machine carries out a self-checking process to ensure that all facilities are operational. Following confirmation of this, the transfer means 31 moves the first garment from the storage zone to the pressing zone. With the pressing rollers 71, heat applying surfaces 83 and spreading brushes 101 in their respective spaced positions, the shuttle then moves upwardly passed the article at the ironing zone, and at this stage the article identification means determined the type of article (in this case being a garment). At the same time, the nature of the fabric may also be identified if the machine has such a facility. The machine selects the variables of the ironing process according to the type of garment and the garment fabric. The upper and lower carriages 73 and 81 are respectively moved towards each other thereby to move the spreading means, heat applying means and pressing means into the ironing zone so as to contact the garment on downward movement of the shuttle. The drive motor 57 is reversed thereby to cause the shuttle 47 to move downwardly. As the opposed brushes 101 of the spreading means traverse opposed sides of the garment, they apply side thrusts which spread the garment and removing loose folds therefrom. The steaming means sprays steam onto the garment by way of the steam nozzles 99 and the heating means applies heat and pressure to the garment. The two rows of heat applying fingers 85 co-operate with each other while traversing opposed sides of the garment. The fingers 85 float over the surface of the garment as the shuttle 47 moves downwardly and thereby accommodate irregularities in the surface contour of the garment. The co-operating pressing rollers 71 are in pressing contact with the garment and apply a pressing treatment to the garment. When the shuttle 47 arrives at the lowermost position, the ironed garment is again scanned and the image thereof compared to the image of a correspondingly properly ironed garment. If the ironing process is satisfactory, the garment is returned to the storage zone and the next garment is transferred to the ironing zone. If the image of the ironed garment falls outside the specified limited, the ironing process is repeated.

Referring now to FIGS. 9 to 13 of the drawings, the ironing machine according to the second embodiment is similar to that of the first embodiment with the exception that on each ironing assembly 68, the heat applying surface is defined by a resiliently deformably pad 103 instead of a row of fingers. The pad 103 comprises a base of resilient material 105 bonded to a rigid backing member 107. A skin 109 of flexible material such as silicone rubber overlays the base and presents a heat applying surface 83 to the ironing zone. Associated with the pad is a heat source 110 which in this embodiment is an electrical resistance heating element woven into the skin. The exposed surface of the skin is coated with a low friction material to allow the surface to glide over an article with which it is in contact at the ironing zone. The resiliently deformable nature of the pad allows it to accommodate irregularities in the surface of the article.

From the foregoing, it is evident that the present invention provides an ironing machine which automatically irons articles, the only manual operations being placement of the articles on hangers and insertion of the articles into, and removal of the articles from, the machine.

The claims defining the invention are as follows:

1. An ironing machine comprising an ironing zone to receive an article to be ironed, a heat applying means for applying heat to an article received at the ironing zone, said heat applying means being supported for movement relative to said ironing zone for traversing the said ironing zone, means for applying heat directly to said heat applying means, said heat applying means including two opposed heat applying surfaces, one disposed on each side of said ironing zone for contacting a surface of an article at the ironing zone, said opposed heat applying surfaces having sufficient resilience for conforming to the surface contour of the article in said ironing zone while traversing said ironing zone.

2. An ironing machine according to claim 1 wherein said heat applying surfaces are each defined by a plurality of resilient independently movable elements.

3. An ironing machine according to claim 2 wherein the movable elements comprise fingers of heat conductive material, said fingers being urged into a contacting position for contacting an article at the ironing zone.

4. An ironing machine according to claim 3 wherein said fingers are mounted for angular movement about an axis transverse to the direction of traverse of the ironing zone.

5. An ironing machine according to claim 1 wherein said heat applying surfaces each comprise a resiliently deformable surface.

6. An ironing machine according to claim 5 wherein each said resiliently deformable surface is defined by a pad of resiliently deformable construction.

7. An ironing machine according to claim 6 wherein each pad is provided with an electrical resistance heating element.

8. An ironing machine according to claim 1 wherein the heat applying surfaces are each movable laterally with respect to the direction of traverse of the ironing zone between an operative position in which the surface can contact an article at the ironing zone and an inoperative position in which the surface is clear of an article at the ironing zone.

9. An ironing machine according to claim 1 further comprising steam applying means for applying steam to the article in an area contiguous to the application of heat to the article by the heat applying means.

10. An ironing machine according to claim 1 further comprising pressing means for pressing an article at the ironing zone, said pressing means being disposed on one side of the heat applying means in the direction of travel and arranged to traverse the ironing zone with the heat applying means.

11. An ironing machine according to claim 10 wherein the pressing means comprises a pair of cooperating pressing surfaces provided on opposed sides of the ironing zone.

12. An ironing machine according to claim 11 wherein the pressing surfaces are each movable laterally with respect to the direction of traverse of the ironing zone between an operative position in which the surface can contact an article at the ironing zone and an inoperative position in which the surface is clear of an article at the ironing zone.

13. An ironing machine according to claim 11 wherein the pressing surfaces are in the form of pressing rollers.

14. An iron machine according to claim 1 further comprising steam applying means and pressing means and wherein said heat applying means, steam applying means and pressing means are carried on a shuttle arranged to traverse the ironing zone.

15. An ironing machine according to claim 14 wherein the shuttle in use tranverses the ironing zone vertically.

16. An ironing machine according to claim 15 further comprising means to suspend an article vertically at the ironing zone.

17. An ironing machine according to claim 1 further comprising a spreading means for spreading an article at the ironing zone for the purpose of removing unwanted folds prior to the ironing operation, said spreading means being disposed ahead of the heat applying means and arranged to traverse the ironing zone with the heat applying means.

18. An ironing machine according to claim 17 wherein said spreading means comprise rotatable devices which in use engage the article and impart sideways thrust thereto to effect the spreading action.

19. An ironing machine according to claim 18 wherein the rotatable devices are each movable laterally with respect to the direction of traverse of the ironing zone between an operative position in which the device can contact an article at the ironing zone and an inoperative position in which the device is clear of an article at the ironing zone.

20. An ironing machine according to claim 1 further comprising a transfer means for transferring an article from a first storage zone to the ironing zone at which the ironing operation is performed and thereafter transferring the ironed article to a second storage zone.

21. An ironing machine according to claim 20 wherein the transfer means conveys articles through the machine supported on a hangers.

22. An ironing machine according to claim 1 further comprising a first means for identifying the type of article at said ironing zone and generating a first signal representative thereof, a second means for detecting the type of the fabric from which the article is made and generating a second signal representative thereof, and a control means arranged to receive the first and second signals and being operable to control one or more variables of the ironing process according to the type of article and the fabric type.

23. An ironing machine according to claim 22 wherein the first means for identifying the, type of article includes an imaging means for scanning the article and registering the image thereof.

24. An ironing machine comprising a storage zone adapted to hold articles to be ironed, an ironing zone to receive an article to be ironed, a heat applying means for applying heat to an article received at said ironing zone, said heat applying means being movable relative to the ironing zone for traversing the ironing zone, said heat applying means including two opposed heat applying surfaces one disposed on each side of said ironing zone for contacting a surface of an article at said ironing zone, transfer means for sequentially moving articles from said storage zone into said ironing zone and back to said storage zone, a first means for identifying the type of article at said ironing zone and generating a first signal representative thereof, a second means for detecting the type of the fabric from which the article is made and generating a second signal representative thereof, and a control means arranged to receive the first and second signals and being operable to control one or more variables of the ironing process according to the type of article and the fabric type.

25. An ironing machine according to claim 24 wherein a continuous conveying means extends from the storage zone into the ironing zone and back to the storage zone.

26. An ironing machine according to claim 25 further including cabinet means adapted to contain the ironing machine.

27. An ironing machine according to claim 26 wherein the cabinet means includes closures therefor and the conveyor means is movable at least partially externally of the cabinet means upon opening of the closure means therefor.

28. An ironing machine according to claim 24 wherein the first means for identifying the type of article includes an imaging means for scanning the article and registering the image thereof.

29. An ironing machine according to claim 24 wherein the articles to be ironed are supported on hangers.

30. An ironing machine comprising an ironing zone to receive an article to be ironed, a heat applying means for applying heat to an article received at the ironing zone, said heat applying means being supported for movement relative to said ironing zone for traversing said ironing zone, the heat applying means including two opposed heat applying surfaces one disposed on each side of said ironing zone for contacting a surface of an article at the ironing zone and a spreading means for spreading an article at said ironing zone for the purpose of removing unwanted folds prior to the ironing operation, said spreading means being disposed ahead of said heat applying means and supported for movement with said heat applying means to traverse said ironing zone with the said heat applying means.

31. An ironing machine according to claim 30 wherein said spreading means comprise rotatable devices which in use engage the article and impart sideways thrust thereto to effect the spreading action.

32. An ironing machine according to claim 31 wherein the rotatable devices are each movable laterally with respect to the direction of traverse of the ironing zone between an operative position in which the device can contact an article at the ironing zone and an inoperative position in which the device is clear of an article at the ironing zone.

33. An ironing machine comprising an ironing zone to receive an article to be ironed, a heat applying means for applying heat to an article received at the ironing zone, the heat applying means being movable relative to the ironing zone for traversing the ironing zone, the heat applying means including two opposed heat applying surfaces one disposed on each side of the ironing zone for contacting a surface of an article at the ironing zone, steam applying means for applying steam to the article in conjunction with the application of heat to the article by the heat applying means, pressing means for pressing an article at the ironing zone, said pressing means being disposed rearwardly of the heat applying means, said steam applying means and said pressing means being movable with said heat applying means.

34. An ironing machine according to claim 33 wherein the pressing means comprises a pair of cooperating pressing surfaces provided on opposed sides of the ironing zone.

35. An ironing machine according to claim 34 wherein the pressing surfaces are each movable laterally with respect to the direction of traverse of the ironing zone between an operative position in which the surface can contact an article at the ironing zone and an inoperative position in which the surface is clear of an article at the ironing zone.

36. An ironing machine according to claim 35 wherein the pressing surfaces are in the form of pressing rollers.

37. An ironing machine according to claim 36 wherein said heat applying means, steam applying means and pressing means are carried on a shuttle arranged to traverse the ironing zone.

38. An ironing machine according to claim 37 wherein the shuttle in use traverses the ironing zone vertically.

39. An ironing machine according to claim 38 further comprising means to suspend an article vertically at the ironing zone.

40. An ironing machine comprising an ironing zone to receive an article to be ironed, a heat applying means for applying heat to an article received at the ironing zone, the heat applying means being movable relative to the ironing zone for traversing the ironing zone, the heat applying means including two opposed heat applying surfaces one disposed on each side of the ironing zone for contacting a surface of an article at the ironing zone, first means for identifying the type of article at said ironing zone and generating a first signal representative thereof, a second means for detecting the type of the fabric from which the article is made and generating a second signal representative thereof, and a control means arranged to receive the first and second signals and being operable to control one or more variables of the ironing process according to the type of article and the fabric type.

41. An ironing machine according to claim 40 wherein the first means for identifying the type of article includes an imaging means for scanning the article and registering the image thereof.

* * * * *